United States Patent [19]

Goulds et al.

[11] 3,944,076

[45] Mar. 16, 1976

[54] APPARATUS FOR SORTING OBJECTS BY CONDUCTIVITY OR RESISTIVITY

[75] Inventors: Anthony John Goulds; Andrew Balint, both of London, England

[73] Assignee: Gunson's Sortex (Mineral and Automation) Limited, London, England

[22] Filed: Oct. 24, 1974

[21] Appl. No.: 517,654

[30] Foreign Application Priority Data

Oct. 26, 1973 United Kingdom ..... 49967/73

[52] U.S. Cl. ..... 209/73; 209/81 R

[51] Int. Cl.[2] ..... B07C 5/344

[58] Field of Search ..... 209/81 R, 81 A, 73

[56] References Cited

UNITED STATES PATENTS

| | | | |
|---|---|---|---|
| 2,101,381 | 12/1937 | Appleyard | 209/81 R |
| 2,131,930 | 10/1938 | Appleyard | 209/81 R |
| 2,587,158 | 2/1952 | Hofberg | 209/81 R |
| 3,587,849 | 6/1971 | Dwyer | 209/81 R |

*Primary Examiner*—Robert B. Reeves
*Assistant Examiner*—David A. Scherbel
*Attorney, Agent, or Firm*—McGarry & Waters

[57] ABSTRACT

The invention concerns sorting apparatus comprising an electrically conductive member the location of which is at least substantially fixed; a horizontally disposed rotary plate adapted to support objects to be sorted and to carry them, while so supported, past the electrically conductive member, at least a portion of the plate being electrically conductive; means for feeding the objects to a region of said plate which is spaced from the axis thereof; guide baffles for guiding the objects from said region to said electrically conductive member, the electrically conductive member being disposed adjacent said plate; control circuit responsive to the electrical conductivity or resistivity of the objects; the electrically conductive member, the said electrically conductive portion, and the control circuit being connected in a normally open electrical circuit which is adapted to be completed by an object on the said electrically conductive portion as it passes the electrically conductive member; and a sorting device, controlled by said control circuit, for effecting a relative separation between those objects which have, and those which fail to have, a predetermined electrical conductivity.

10 Claims, 3 Drawing Figures

APPARATUS FOR SORTING OBJECTS BY CONDUCTIVITY OR RESISTIVITY

Figure 1:
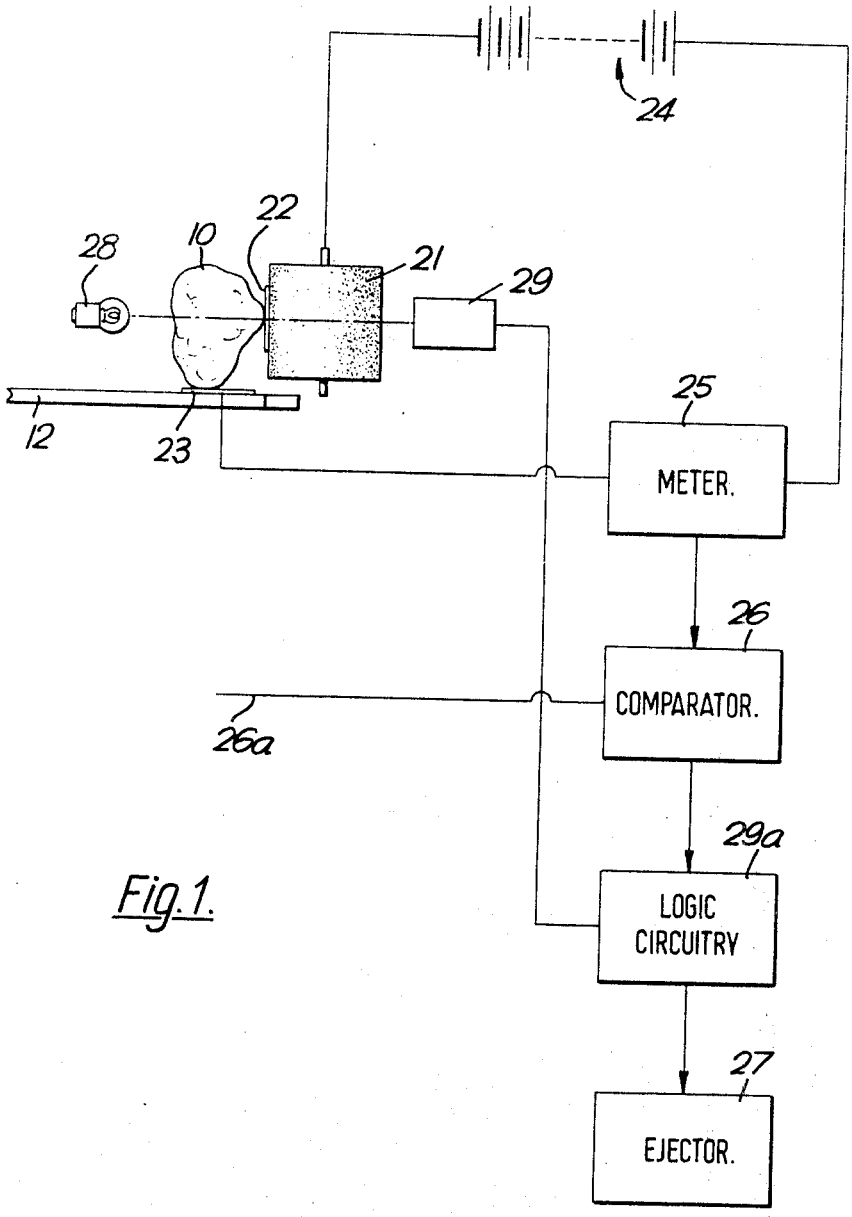

This invention concerns a method and an apparatus for sorting desired from undesired objects in accordance with the electrical conductivity or resistivity of the objects. The term "objects" is used in this specification in a broad sense to include particles of particulate material.

According to the present invention, there is provided sorting apparatus comprising an electrical contact or electrode member the location (other than, if desired, the angular disposition) of which is at least substantially fixed; rotary carrier means adapted to support objects to be sorted and to carry them, while so supported, past the contact or electrode member, or at least a portion of the carrier means being electrically conductive; control means responsive to the electrical conductivity or resistivity of the objects, the contact or electrode member, the said electrically conductive portion, and the control means being connected in a normally open electrical circuit which is adapted to be completed by an object on the said electrically conductive portion as it passes the contact or electrode member; and a sorting device, controlled by said conrol means, for effecting a relative separation between those objects which have, and those which do not have, a predetermined electrical conductivity or resistivity.

Thus since the angular disposition of the contact or electrode member need not be fixed, the contact or electrode member may be a rotary or an oscillatory member. In this case, however, the axis of the contact or electrode member will be fixed or substantially fixed, i.e. capable of only very small movement.

The control means is preferably responsive to the presence of an object at the contact or electrode member irrespective of whether the object is electrically conductive or not, the sorting device separating non-conductive objects from those having the said predetermined electrical conductivity or resistivity.

Indicator means are preferably provided for indicating the presence or absence of an object at the contact or electrode member.

The contact member is preferably a brush, e.g. a vertically disposed brush. The brush may, if desired, be a rotary brush.

Alternatively, the contact member may be a flat plate.

Yet again, the contact member may be constituted by a needle electrode which is arranged to be charged to a sufficiently high voltage so that a corona dischage occurs between the needle electrode and the said electrically conductive portion of the carrier means, the corona discharge breaking down into a spark when a sufficiently conductive object supported on the electrically conductive portion passes adjacent to the needle electrode. In this case, the said control means is arranged to detect the sudden change of current which occurs on the production of said spark.

The rotary carrier means may be constituted by a conical member but preferably comprises an horizontally disposed rotary plate. Preferably there are means for feeding the objects to a region of said plate which is spaced from the axis thereof, and guide means for guiding the objects from said region to said contact or electrode member, the contact or electrode member being disposed adjacent said plate.

The contact or electrode member may be disposed either radially outwardly or radially inwardly of the said region.

The guide means are preferably such that the objects are carried one at a time past the contact or electrode member.

The sorting device may comprise means for directing a fluid jet against objects which do not have the said predetermined electrical conductivity or resistivity so as to remove them from the other objects.

The invention also comprises a method of sorting desired from undesired objects comprising supplying the objects to a rotary carrier means; at least a portion of which is electrically conductive, rotating the carrier means so that the objects supported thereon are moved past an electrical contact or electrode member, the location (other than, if desired, the angular disposition) of the contact or electrode member being at least substantially fixed; measuring the electrical conductivity or resistivity of each object when it is supported on said portion and passes said contact or electrode member; and effecting, in dependence upon said measurement, a relative separation between those objects which have, and those which do not have, a predetermined electrical conductivity or resistivity.

The objects are preferably pieces of ore, e.g. iron ore.

Figure 2:
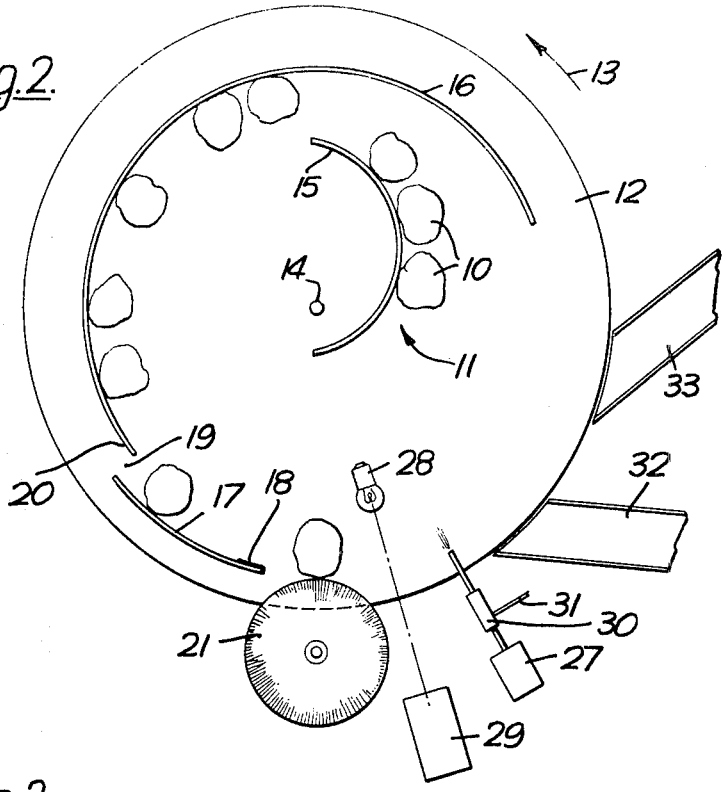
Figure 3:
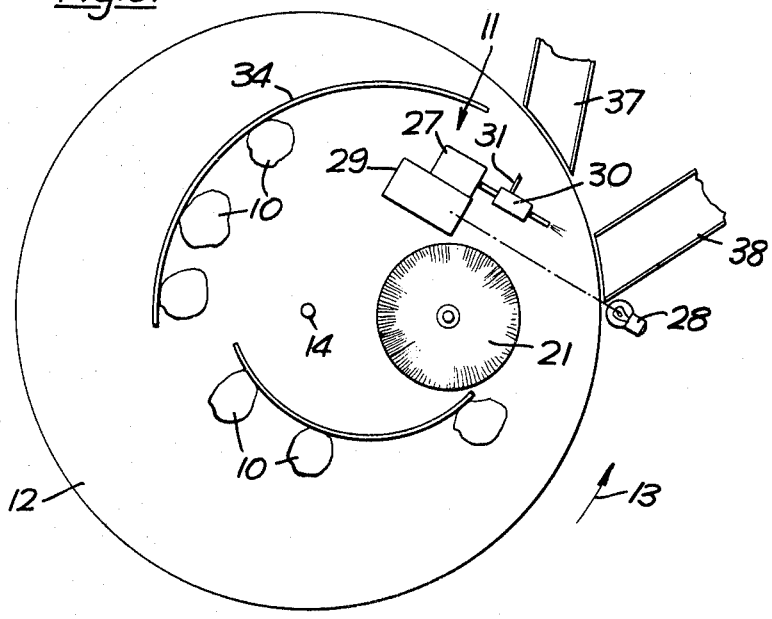

The invention is illustrated, merely by way of example, in the accompanying drawings, in which:

FIGS. 1 and 2 are diagrammatic elevational and plan views respectively of a sorting apparatus in accordance with the present invention, and FIG. 3 is a diagrammatic plan view of an alternative sorting apparatus in accordance with the present invention.

In FIGS. 1 and 2 there is shown diagrammatically a sorting apparatus which may be used for sorting pieces of ore 10 so as to effect a relative separation between the pieces 10 which have, and those which do not have, a predetermined electrical conductivity or resistivity. As a result of such sorting an "enriched" ore may be obtained. For example, the invention is applicable to the enrichment of iron ore since the conductivity of pieces of iron ore varies in accordance with the iron content thereof.

The pieces of ore 10 are supplied from a hopper, or other container, not shown, to a region 11 of an horizontally disposed rotary plate 12 which is arranged to be rotated in the direction of arrow 13, the region 11 being spaced from the axis 14 of the rotary plate 12.

Mounted on the rotary plate 12 are vertically extending guide baffles 15, 16, 17. The baffle 17 has an electrically insulated portion extending (e.g. through a circumferential distance of 1 inch) to the outlet end 18 of the baffle 17. The guide baffle 15 is a curved baffle whose external side is contacted by the pieces of ore 10 and whose curvature is such that the pieces of ore 10 are, in operation, guided by the guide baffle 15 towards the internal surface of the guide baffle 16. The guide baffles 16, 17 are mounted concentrically of the rotary plate 12, the guide baffle 17 being mounted radially outwardly of the guide baffle 16. The pieces of ore 10 which reach the outlet end 20 of the guide baffle 16 move radially outwardly through a gap 19 and into contact with the internal surface of the guide baffle 17, although the gap 19 may be omitted if desired. The baffles 15, 17 and the gap 19 (if provided) serve to "singulate" the pieces of ore 10, i.e. to separate them into a line of single pieces of ore. As a result, each piece of ore is carried, one at a time, past and in contact with an electrically conductive brush 21. The location of the brush 21 is fixed, although the brush 21 may, if desired, rotate.

As each piece of ore 10 is carried by the rotary plate 12 past the brush 21, it effects simultaneous contact with a contact portion 22 of the brush 21 and with a contact portion 23 of the rotary plate 12. This contact portion 23, and optionally the whole rotary plate 12, is electrically conductive, e.g. of steel, and is connected in a normally open electrical circuit which includes the brush 21, an electrical power source 24, a meter 25 which is responsive to the electrical conductivity or resistivity of the pieces of ore 10 and which passes signals to a comparator 26 which compares the measurement signals produced by the meter 25 with a datum supplied by way of a line 26*a*. Accordingly, whenever a piece of ore 10, which is electrically conductive but whose electrical conductivity or resistivity is below a predetermined value, contacts the brush 21, the comparator 26 sends an ejection signal to an ejector 27 so that the piece of ore may be removed.

The electrical circuit also includes a lamp 28 and an electronic switch 29 which responds to the light of the lamp 28, the lamp 28 being placed on the exit side of the brush 21 and as close to the latter as is practicable. The beam from the lamp 21 is thus temporarily interrupted whenever a piece of ore 10 contacts the brush 21 irrespective of whether the piece of ore 10 is electrically conductive or not. The switch 29 thus indicates the presence or absence of a piece of ore. Moreover, the switch 29 is arranged to send a signal to the ejector 27 by way of logic circuitry 29*a* whenever the light beam from the lamp 28 is interrupted so that the ejector 27 will effect ejection both of non-conductive pieces of ore and of pieces of ore whose conductivity is below a predetermined value, the ejection being also timed from the instant when the light beam is interrupted.

The ejector 27 comprises a valve 30 in a compressed air line 31, such that when an ejection signal is supplied to the ejector 27, the valve 30 opens and a jet of compressed air passes through the line 31 so as to impinge on the piece of ore 10 which is to be removed.

Pieces of ore 10 which are to be accepted (i.e. those whose electrical conductivity or resistivity is above a predetermined value) leave the rotary plate 12 tangentially thereof and pass along an acceptance chute 32. Pieces of ore 10, however, whose electrical conductivity or resistivity is below the predetermined value, are deflected by the air jet from the ejector 27 and pass non-tangentially to a rejection chute 33.

As will be appreciated, when a piece of ore 10 is in the position illustrated in FIG. 1, what will be measured is the resistivity or conductivity of the piece of ore 10 over the distance between the contact portions 22, 23. Since the brush 21 is substantially fixed in position (even though it may, if desired, rotate and may be very slightly movable to permit operation of the switch 29), the size of the piece of ore 10 will not affect the measurement produced by the meter 25, so that it is not necessary to compensate for variation in the size of the pieces 10.

The construction shown in FIG. 2 involves the use of large centrifugal forces, the pieces of ore 10 being centrifuged from the delivery region 11 to the brush 21. If, however, it is not desired or practicable to use large centrifugal forces, the construction shown in FIG. 3 may be employed.

In the arrangement shown in FIG. 3, the delivery region 11, instead of being disposed radially inwardly of the brush 21, as in the FIG. 2 construction, is disposed radially outwardly thereof. Vertically extending guide baffles 34, 35 are provided such that the pieces of ore 10 are, in operation, carried along the internal surface of the guide baffle 34 so that they are cammed thereby radially inwardly.

The pieces of ore 10 then move from the outlet end 36 of the guide baffle 34 and pass along the outer surface of the guide baffle 35 so as to move, one at a time, past and in contact with the brush 21. Pieces of ore whose electrical conductivity or resistivity is above a predetermined value and which are thus accepted pass tangentially to an acceptance chute 37, while pieces of ore 10 whose electrical conductivity or resistivity is below a predetermined value pass to a rejection chute 38 as a result of the impingement thereon of a jet of air from the ejector 27.

In the constructions described above with reference to FIGS. 2 and 3, the ejector 27 is arranged to reject those pieces of ore 10 whose electrical conductivity or resistivity is below a predetermined value. However, the ejector 27 could alternatively be arranged to reject those pieces of ore 10 whose electrical conductivity or resistivity is above a predetermined value.

It will be appreciated that the apparatus illustrated in the drawings is of a simple and robust character.

We claim:

1. Sorting apparatus comprising an electrically conductive member the location of which is at least substantially fixed; a horizontally disposed rotary plate adapted to support objects to be sorted and to carry them, while so supported, past the electrically conductive member, at least a portion of the plate being electrically conductive; means for feeding the objects to a region of said plate which is spaced from the axis thereof; guide means for guiding the objects from said region to said electrically conductive member, the electrically conductive member being disposed adjacent said plate; control means responsive to the electrical conductivity or resistivity of the objects; the electrically conductive member, the said electrically conductive portion, and the control means being connected in a normally open electrical circuit which is adapted to be completed by an object on the said electrically conductive portion of said plate as it passes the electrically conductive member; and a sorting device, controlled by said control means, for effecting a relative separation between those objects which have, and those which fail to have, a predetermined electrical conductivity.

2. Sorting machine as claimed in claim 1 in which the electrically conductive member is a brush.

3. Sorting apparatus as claimed in claim 1 in which the electrically conductive member is disposed radially outwardly of the said region.

4. Sorting apparatus as claimed in claim 1 in which the electrically conductive member is disposed radially inwardly of the said region.

5. Sorting apparatus as claimed in claim 1 in which the guide means are such that the objects are carried one at a time past the electrically conductive member.

6. Sorting apparatus as claimed in claim 1 in which the sorting device comprises means for directing a fluid jet against objects which fail to have the said predetermined electrical conductivity so as to remove them from the other objects.

7. Sorting apparatus comprising an electrically conductive member the location of which is at least substantially fixed; rotary carrier means adapted to support objects to be sorted and to carry them, while so supported, past the electrically conductive member, at least a portion of the carrier means being electrically conductive; control means responsive to the electrical conductivity or resistivity of the objects; the electrically conductive member, the said electrically conductive portion, and the control means being connected in a normally open electrical circuit which is adapted to be completed by an object on the said electrically conductive portion of said plate as it passes the electrically conductive member; a sorting device, controlled by said control means, for effecting a relative separation between those objects which have, and those which fail to have, a predetermined electrical conductivity, the control means being responsive to the presence of an object at the electrically conductive member irrespective of whether the object is electrically conductive, and the sorting device separating nonconductive objects from those having the said predetermined electrical/conductivity.

8. Sorting apparatus comprising an electrically conductive member the location of which is at least substantially fixed; rotary carrier means adapted to support objects to be sorted and to carry them, while so supported, past the electrically conductive member, at least a portion of the carrier means being electrically conductive; control means responsive to the electrical conductivity or resistivity of the objects; the electrically conductive member, the said electrically conductive portion, and the control means being connected in a normally open electrical circuit which is adapted to be completed by an object on the said electrically conductive portion of said plate as it passes the electrically conductive member; a sorting device, controlled by said control means, for effecting a relative separation between those objects which have, and those which fail to have, a predetermined electrical conductivity, and indicator means for indicating the presence and absence of an object at the electrically conductive member.

9. Sorting apparatus comprising an electrically conductive rotary brush the location of which is at least substantially fixed; rotary carrier means adapted to support objects to be sorted and to carry them, while so supported, past the electrically conductive rotary brush, at least a portion of the carrier means being electrically conductive; control means responsive to the electrical conductivity or resistivity of the objects, the electrically conductive rotary brush, the said electrically conductive portion, and the control means being connected in a normally open electrical circuit which is adapted to be completed by an object on the said electrically conductive portion as it passes the electrically conductive rotary brush; and a sorting device, controlled by said control means, for effecting a relative separation between those objects which have, and those which fail to have, a predetermined electrical conductivity.

10. Sorting apparatus as claimed in claim 9 in which the axis of the brush is vertically disposed.

* * * * *